United States Patent [19]

Malhere et al.

[11] Patent Number: 4,751,897

[45] Date of Patent: Jun. 21, 1988

[54] HEATING BODIES FOR GAS WATER HEATERS

[75] Inventors: Claude Malhere, Beaumesnil; Jean-Michel Porcher, Rambouillet, both of France

[73] Assignee: Chaffoteaux et Maury, France

[21] Appl. No.: 24,633

[22] Filed: Mar. 11, 1987

[30] Foreign Application Priority Data

Mar. 14, 1986 [FR] France ..... 86 03689

[51] Int. Cl.[4] ..... F22B 5/02

[52] U.S. Cl. ..... 122/19; 122/264; 126/350 R; 126/132

[58] Field of Search ..... 122/14, 18, 19, 350, 122/367 C, 264, 277; 126/350 R, 132, 133

[56] References Cited

U.S. PATENT DOCUMENTS 4,361,276 11/1982 Paige ..... 122/18 X
4,403,573 9/1983 Cauchy ..... 126/132 X
4,413,590 11/1983 Landreau ..... 122/14 X
4,421,066 12/1983 Gordbegli ..... 122/264

FOREIGN PATENT DOCUMENTS 2178561 11/1973 France ..... 122/367 C

*Primary Examiner*—Edward G. Favors
*Attorney, Agent, or Firm*—Townsend and Townsend

[57] ABSTRACT

A heating body is provided for a gas water heater in the form of a vertical tubular chamber (1) obstructed at its upper end by a heat exchanger (2) itself having a pipe section (4) through which the water to be heated flows, the rear (6) and side (7,8) portions of the wall of said chamber being formed by a protective metal sheet (11) lined on the inside with a refractory material body (10). The front portion (9) of said wall is a heat conducting metal panel adapted so as to form a capacity or chamber (16) through which the water to be heated flows just upstream of the exchanger.

8 Claims, 1 Drawing Sheet

HEATING BODIES FOR GAS WATER HEATERS

Figure 1:
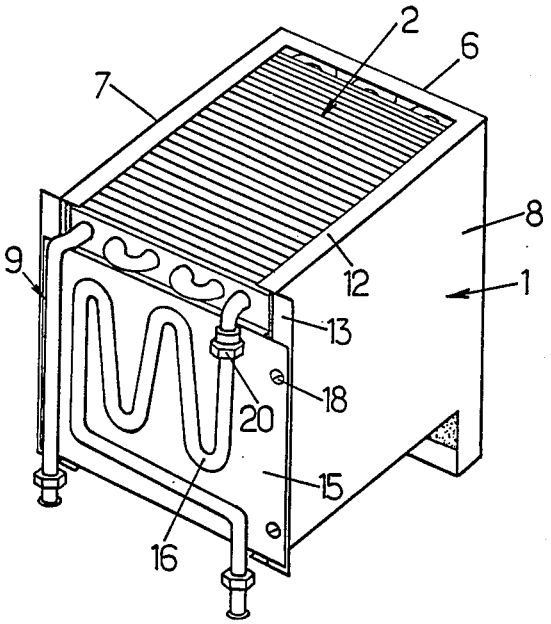

The invention relates to heating bodies forming apparatus intended for heating water by combustion of a gas, which bodies are in the form of a vertical tubular chamber through which flames and burnt gases travel from bottom to top and which is obstructed at its upper end by a heat exchanger itself including a pipe section through which the water to be heated flows.

In known embodiments, these heating bodies are divided into two categories, namely wet chambers and dry chambers.

Wet chambers are formed by a metal sheet chimney about which is coiled a tube intimately associated therewith by brazing, said tube being intended to have flowing therethrough the water to be heated before admission thereof into the exchanger.

These constructions are costly and the coiled tube is not removable: it cannot therefore be replaced, for example should it become furred up.

Dry chambers overcome these drawbacks.

They are formed by a sleeve made from a refractory material, such as a silica-alumina mixture, coated outwardly with a metal protective wall, said sleeve having the exchanger disposed thereover.

This construction lends itself readily to automated manufacture and to removal of the whole of the piping intended to have the water to be heated flowing therethrough.

But for some water heater constructions, the above described dry chambers have the drawback of causing overheated water to be distributed during repeated drawing off operations.

In fact, the refractory body forming the internal face of the dry chamber is very little cooled between successive drawing off operations and the amount of heat accumulated in this body during each operation of the apparatus—and even between successive operations, because the pilot light is permanently lit—is relatively high to the extent that this body is often red hot.

The result is that the volume of water contained in the exchanger, a relatively small volume, is highly heated by this refractory body.

According to the standards generally applied to water heaters, such apparatus should raise the temperature of the cold water admitted by about 50° for prolonged drawing off conditions and, at the beginning of each drawing off operation, this temperature rise should not exceed this operating value by more than 20° C.

Thus, for a cold water temperature of 20° C., the hot water drawn off should be brought to a temperature of the order of 70° C. and this temperature should remain less than 90° at the beginning of each drawing operation.

With known dry chambers of the above described type, this latter value is often exceeded and may reach within a few degrees the boiling temperature of water, which is of course not admissible.

The aim of the invention is especially to overcome these drawbacks by limiting to about 15° C. the initial maximum overheating likely to be observed at the beginning of repeated drawing off operations.

For this, the heating bodies of the invention again have, like the dry chambers, a wall portion made from a refractory material lined outwardly by a simple protective metal sheet, that is to say without any water duct, and they are essentially characterized in that the front portion of their wall is a heat conducting metal panel adapted so as to form a capacity or chamber through which the water to be heated passes just upstream of the exchanger.

In preferred embodiments of the invention, recourse is further had to one and/or the other of the following arrangements:

the front panel is mounted on the rest of the heating body so as to be readily removable, particularly by screwing, the water chamber formed by the front panel has an end piece oriented vertically upwardly and adapted to be readily connected to a vertically downwardly oriented end piece provided at the end of the pipe section of the exchanger, the front panel is formed by a metal sheet on which a pipe section forming the water chamber is intimately brazed, the section mentioned in the preceding paragraph includes a zig zag shaped tube, the straight sections of the zig zags mentioned in the preceding paragraph are oriented vertically, the front panel is formed by two parallel dividing walls slightly spaced apart from each other whose edges are brought sealingly together so as to form the water chamber, one at least of the two dividing walls mentioned in the preceding paragraph has hollow impressions whose bottoms are welded against the other dividing wall, the exchanger is in the form of a drawer horizontally movable above the front panel and adapted to be removably housed inside the U formed by the three other panels defining the heating body.

The invention includes, apart from these main arrangements, certain other arrangements which are used preferably at the same time and which will be more explicitly discussed hereafter.

In what follows, a preferred embodiment of the invention will be described with reference to the accompanying drawings in a way which is of course in no wise limitative.

FIG. 1 of these drawings shows a perspective view of a water heater heating body constructed in accordance with the invention.

Figure 2:
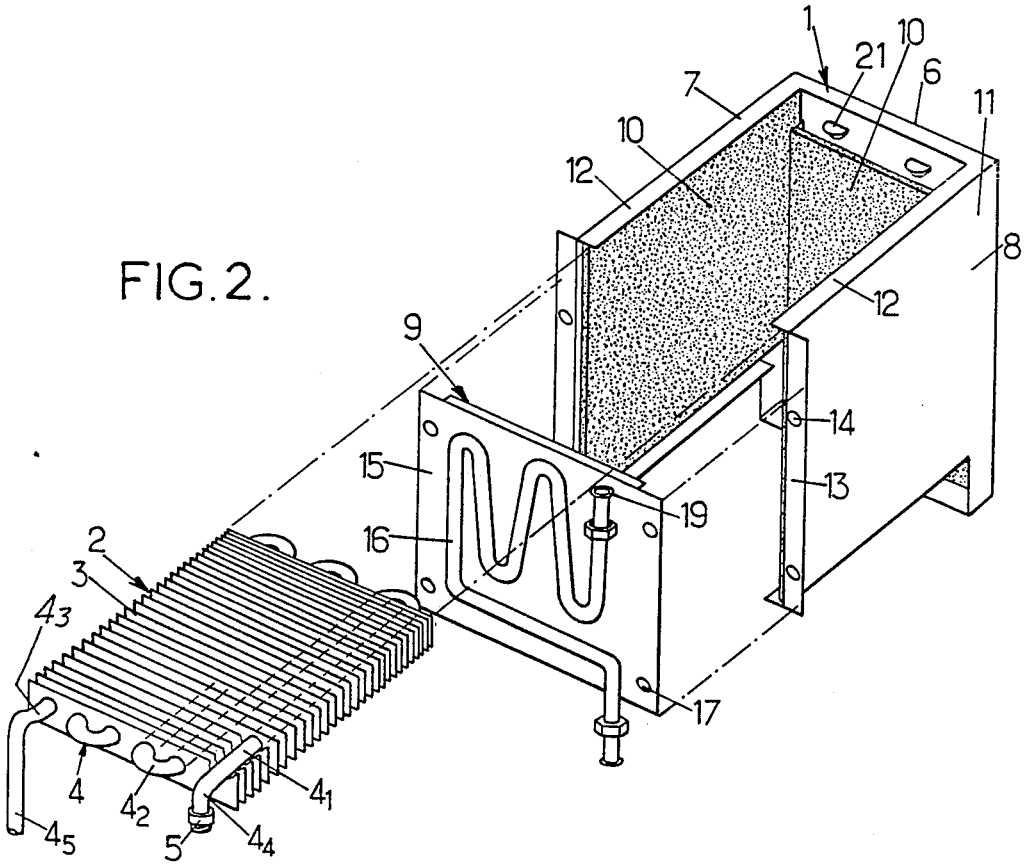

FIG. 2 shows similarly the same heating body with its exchanger and its front panel removed.

The heating body here considered includes:

a vertically oriented tubular chamber 1 having a horizontal rectangular or square section, and a heat exchanger 2 extending across the upper end of chamber 1.

Chamber 1 is equipped at its base with ramps of burners (not shown) fed with fuel gas and its role is to guide the flames from these ramps and the corresponding hot gases towards the exchanger.

Exchanger 2 is formed, in a way known per se, by a succession of vertical and parallel fins 3 spaced apart by the parallel rectilinear sections $4_1$ of a pipe section 4 through which the water to be heated flows, said sections forming zig zags with semicircular connections $4_2$ which connect their ends together in twos.

The zig zag portion of section 4 is itself extended outwardly of the exchanger by two downwardly turned bends $4_3$, $4_4$, one of which is itself extended by a vertical section $4_5$ whereas the other bend ends in an piece 5 threaded for connection purposes.

Chamber 1 includes four flat panels, namely a rear panel 6, two side panels 7 and 8 and a front panel 9, the front of the chamber being the zone where the user stands who controls the water heater when the rear corresponds to a support wall in the most general case where it is a question of a wall mounted apparatus.

Each of the three rear 6 and side 7 and 8 panels is formed, as for known dry chambers, by a plate 10 made from a refractory material, particularly from silica-alumina, lined outwardly with a metal plate 11.

The three plates 11 are formed preferably by bending the same galvanized metal sheet in a right angled U.

The edges of the three metal walls 11 are themselves bent back at right angles so as to form stiffening flanges for the partial box formed, the horizontal flanges 12 further serving as guide and/or closure flanges whereas the vertical edges 13, perforated at 14, serve as support surface.

The front panel 9 is formed by a rectangular or square metal sheet 15 made from a heat conducting metal such as copper, on the outer face of which is brazed a pipe section 16 also formed from a heat conducting metal such as copper.

This metal sheet 15 is pierced close to its vertical edges with apertures 17 and it is fixed by screwing to the above vertical flanges 13 by means of screws 18 engaging with the holes 14.

In the embodiment illustrated, the pipe section 16 is a zig zag coil having vertical rectilinear sections and ending at the top in a widened end piece 19 (FIG. 2) disposed in a position such that it may be readily and sealingly connected to the above end piece 5 using any appropriate readily removable connection 20, preferably of a screw type (FIG. 1).

The assembly of the exchanger 2 and the pipe sections which extend therefrom form a horizontally movable drawer above the front panel 9 so as to be readily positioned in the upper zone of chamber 1, from the front of the apparatus, and to be withdrawn forwardly from this zone.

The vertical positioning of this drawer with respect to chamber 1 is provided advantageously, at the rear, by its semicircular rear sections $4_2$ resting on horizontal lugs 21 formed in the rear metal sheet 11, and at the front by the formation of the connection 20.

It follows from the above described construction that exchanger 2 and the front panel 9 may be very easily removed from the rest of the heating body, independently of each other, which simplifies repair or cleaning thereof and allows replacement thereof if required.

In addition, the presence of the pipe sections 16 just upstream of the exchanger 2 and in the immediate vicinity of the hot walls of chamber 1 increases the volume of water held in the hot portion of the apparatus between successive drawing operations, and so increases the heat capacity of this volume of water and reduces the momentary overheating thereof.

The maximum value of overheating likely to be observed at the beginning of each drawing off operation carried out short after a previous drawing operation may thus be limited to less than 20° C., even 15° C.

Furthermore, the front water jacket panel 9 forms between the combustion chamber and the front portion of the covering of the apparatus a heat screen more efficient than a heat accumulating refractory wall, which reduces the temperature of said front portion and consequently reduces both the feeling of burning experienced by users when their hands or faces are in contact with this front portion and overheating of the volume situated in front of the apparatus.

As is evident, and as it follows moreover already from what has gone before, the invention is in no wise limited to those of its modes of application and embodiments which have been more especially considered; it embraces, on the contrary, all variants thereof, particularly:

those in which the water chamber formed by the front panel is formed otherwise than by a tube extending in zig zags with vertical rectilinear sections brazed to a metal plate, this chamber being formed for example by such a zig zag tube with horizontal rectilinear sections, or else by a double metal dividing wall whose edges are applied sealingly one against the other, one at least of the two dividing walls advantageously having hollow impressions, in particular pin point or linear, whose bottoms are welded to the other dividing wall, which has the double advantage of mechanically reinforcing the construction and of subjecting the flowing water to a turbulence promoting the heat exchange, those in which one or two of the three panels 6, 7, 8 other than the front panel 9 forming the tubular chamber 1 is adapted at least partially like this front panel in the manner of a "wet" wall or water chamber with heat conducting walls, only the remaining panel (or the remaining panels) being then formed in the manner of the above "dry" panels, that is to say having a plate made from a refractory material lined with a simple external metal sheet, and those in which the water heater considered is not a water heating apparatus properly speaking intended solely for intermittent drawing off of hot water, but a water heating apparatus of higher heating power, such as a bath heater or a central heating boiler.

What is claimed is:

1. A heating body for a gas water heater in the form of a vertical tubular chamber (1) obstructed at its upper end by a heat exchanger (2) itself having a pipe section (4) through which the water to be heated is intended to flow, a portion (6, 7, 8) of the wall of said chamber being formed by protective metal sheet (11) lined on the inside with a refractory material body (10) characterized in that the front portion (9) of said wall is a heat conducting metal panel mounted readily removable on the rest of the wall, more particularly by screwing (at 18), and adapted so as to form a capacity or chamber through which the water to be heated flows just upstream of the exchanger.

2. The heating body according to claim 1, characterized in that the water chamber formed by the front panel includes an end piece (19) turned vertically upwardly and adapted to be readily connected to an end piece (5) turned vertically downwardly and provided at one end of the pipe section (4) of the exchanger (2).

3. The heating body according to claim 1, characterized in that the front panel (9) is formed by a metal sheet (15) on which is intimately brazed a pipe section (16) forming the water chamber.

4. The heating body according to claim 3, characterized in that the section (16) brazed on the metal sheet (15) includes a zig zag tube.

5. The heating body according to claim 4, characterized in that the rectilinear sections of the zig zags are oriented vertically.

6. The heating body according to claim 1, characterized in that the front panel is formed by two parallel dividing walls spaced slightly apart from each other whose edges are brought sealingly together so as to form the water chamber.

7. The heating body according to claim 6, characterized in that one at least of the two dividing walls has hollow impressions whose bottoms are welded to the other dividing wall.

8. The heating body according to claim 1, characterized in that the exchanger (2) is in the form of a horizontally movable drawer above the front panel (9) and is adapted to be removably housed inside the U formed by the three other panels (6, 7, 8) defining the heating body.

* * * * *